US006312240B1

(12) United States Patent
Weinbrecht

(10) Patent No.: US 6,312,240 B1
(45) Date of Patent: Nov. 6, 2001

(54) REFLUX GAS COMPRESSOR

(76) Inventor: John F. Weinbrecht, 601 Oakwood Pl., NE., Albuquerque, NM (US) 87123

( * ) Notice: Subject to any disclaimer, the term of this patent is extended or adjusted under 35 U.S.C. 154(b) by 0 days.

(21) Appl. No.: 09/580,047

(22) Filed: May 27, 2000

Related U.S. Application Data

(60) Provisional application No. 60/136,352, filed on May 28, 1999.

(51) Int. Cl.[7] ..... F04C 29/00

(52) U.S. Cl. ..... 418/180; 418/15; 418/206.1; 418/206.4

(58) Field of Search ..... 418/15, 180, 206.4, 418/206.1

(56) References Cited

U.S. PATENT DOCUMENTS

| | | | | |
|---|---|---|---|---|
| 2,489,887 | * | 11/1949 | Houghton | 418/180 |
| 4,859,158 | * | 8/1989 | Weinbrecht | 418/15 |
| 4,995,796 | * | 2/1991 | Kambe et al. | 418/15 |
| 5,090,879 | * | 2/1992 | Weinbrecht | 418/206.4 |
| 5,439,358 | * | 8/1995 | Weinbrecht | 418/206.4 |
| 5,702,240 | * | 12/1997 | O'Neal et al. | 418/180 |

FOREIGN PATENT DOCUMENTS

| | | | | |
|---|---|---|---|---|
| 0865864-A1 | * | 2/1953 | (DE) | 418/15 |
| 64032085-A1 | * | 7/1987 | (JP) | 418/15 |

* cited by examiner

*Primary Examiner*—Thomas Denion
*Assistant Examiner*—Theresa Trieu
(74) *Attorney, Agent, or Firm*—William A. Eklund

(57) ABSTRACT

A positive displacement, recirculating Root's type rotary compressor which operates on a constant volume, near isothermal cycle is disclosed. The compressor includes a pair of involutely lobed impellers and a discharge pressure reflux flow loop. The flow loop includes a discharge port, a flow distributor, an output port, and one or two pair of low impedance rectangular conduits terminating in linear nozzles that serve as reflux ports. Reflux flow through the nozzles is directed with impeller rotation. It isentropically expands into the constant volume displacement cavities so that the contained pressure approaches discharge level. The final pressure increase into discharge is gained through adiabatic compression at a low pressure ratio. The resulting process is inherently non-contaminating, as there are no valves and no contacting or rubbing parts in the flow stream. It can be applied wherever gases or vapors must be compressed.

8 Claims, 3 Drawing Sheets

REFLUX GAS COMPRESSOR

This appln. claims benefit of Prov. No. 60/136,352 filed May 28,1999.

BACKGROUND OF THE INVENTION

1. Field of the Invention

The present invention is generally related to gas compressors and pumps. More particularly, the present invention is related to positive displacement rotary compressors, specifically including those known as Roots blowers and compressors.

2. Description of Related Art Including Information Disclosed Under 37CFR 1.97–1.99

The present invention is related to, and constitutes an improvement over, the rotary gas compressors disclosed in the applicant's previously issued U.S. Pat. Nos. 4,859,158, 5,090,879, and 5,439,358, issued Aug. 22, 1989, Feb. 25, 1992, and Aug. 8, 1995, respectively.

The class of positive displacement compressors known as Roots blowers has been known to and has served industry continuously since the mid 1850's. For certain applications, the Roots blower offers a number of advantages over other types of gas compressors, including conventional reciprocating piston compressors, helical screw compressors, fan-type blowers, centrifugal and roto-dynamic compressors. Among the advantages of the Roots blower are simplicity, ruggedness, trouble-free operation, and high volumetric capacity. Roots blowers do not contaminate the gas being processed, as there are no valves or reciprocating, rubbing, or contacting mechanical parts in the flow stream. The Roots blower maintains constant volume displacement from intake through to discharge, a design feature not found in any other type of positive displacement compressor.

Roots blowers incorporate two lobed impellers, sometimes called rotors, which mesh with one another and which are driven in opposing directions through timing gears attached to each drive shaft. Commercially available Roots blowers usually have impellers with either two or three lobes. Roots blowers have also been designed to incorporate impellers having four or more lobes. Two-lobed impellers have the greatest volumetric capacity per revolution, and are the most common. Volumetric capacity is reduced proportionately by adding additional lobes. The Roots blower excels in moving large volumes of air or other gases against low pressure differentials. Typical applications include compression from atmospheric pressure to from 5 to 7 psig discharge pressure, and non-contaminating evacuation, serving either as a vacuum pump or as a vacuum booster.

Roots blowers have not heretofore been useful for or capable of compressing a gas against a substantial pressure differential. This limitation has been due to heating effects that attend such compression. As a gas is impelled through a conventional Roots blower it is compressed and heated as it enters the discharge region. Such compression is adiabatic, such that the temperature of the gas increases exponentially with increasing pressure ratios. Additional heat resulting from dynamic flow effects is generated as discharge pressure gas surges into impeller cavities and is then expelled in the opposite direction.

The increase in the temperature of the gas leads to heating of the impellers, the housing, and other mechanical parts of the blower. This in turn can lead to thermal distortion, expansion and contact between interior components. At pressure ratios of about two to one (2:1) such effects become a significant problem and essentially limit the sustained operation of the blower. Overheating of the blower can result in lockup or other mechanical failure of the impellers, seals, and other components. This heating problem is not uniform throughout the compressor. The compressor housing, for example, can be externally cooled by a number of conventional methods such as the use of water jackets, heat radiating fins, heat sinks, and the like. The greatest heating problem lies with the impellers, because there is no practical way to directly cool them. Overheating of the impellers leads to their expansion and eventual binding against the housing, causing extensive damage and shutdown. Overheating has been a major limitation on the use of Roots blowers for compressing gas against high pressure differentials.

A significant advance in the art was the development of recirculation cycles to effect a moderate reduction in the heating of Roots compressors. In a recirculating Roots compressor, a portion of the discharge gas, which is compressed to a higher pressure than the input gas, is recirculated back into the compressor so as to effectively increase the pressure of the gas passing through the compressor. In some recirculating compressors a portion of the discharge gas is cooled prior to being recirculated back into the compressor. In both cases the operating temperature of the compressor is effectively reduced, thereby mitigating the overheating problem referred to above. By this means, a capability for sustained operation has been obtained in some cases up to pressure differentials of approximately 2.7:1.

U.S. Pat. No. 2,489,887 to Houghton, for example, discloses the general concept of cooling a Roots compressor by introducing recirculated gas of a lower temperature into the intake gas to reduce heating of the compressor.

U.S. Pat. No. 3,351,227 to Weatherston discloses a multi-lobed Roots-type compressor having feedback passages which allow a portion of the high-pressure discharge gas to be recirculated back into the pump housing. Weatherston however discloses only the use of quite small feedback passages, the size of which are not related to the sizes of the intake and discharge ducts. This results in uneven flow velocities and pressures. As will be apparent from the description of the present invention set forth below, the Weatherston compressor does not solve problems addressed by the present invention.

German Patent No. 2,027,272 to Kruger discloses the concept of cooling and recirculating discharge gas in a two-lobe Roots compressor. The compressor of Kruger, due to its two-lobed configuration, has no provision for preventing communication and backflow from the discharge port into the recirculation ports.

French Patent No. 778,361 to Bucher discloses four-lobed Roots compressors having recirculation ports. The recirculation ports are however small, with the intended purpose of using small nozzle-like ports to allow the recirculated gas to adiabatically cool upon entry into the compressor housing. As will be made apparent from the description below, this teaching of Bucher is contrary to the present invention.

U.S. Pat. No. 4,453,901 to Zimmerly discloses a positive displacement rotary pump, which is designed for pumping liquids, with no provision for recirculation.

U.S. Pat. No. 4,390,331 to Nachtrieb discloses a rotary compressor having four-lobed impellers, but likewise having no provision for recirculation.

U.S. Pat. No. 2,906,448 to Lorenz discloses a rotary positive displacement compressor having two-lobed impellers, with a double-walled construction for cooling purposes.

British Patent No. 282,752 to Kozousek discloses a rotary pump which is characterized by rotor lobes that are particularly shaped so as to provide the maximum possible working space and thereby maximize the volumetric capacity of the pump. The pump disclosed in Kozousek discloses recirculation ports which are made small, and which are for the purpose of obtaining even delivery of the gas.

Various kinds of Roots compressors are commercially available, both with and without recirculation. However, none of the commercially available compressors address the problems of recirculation flow impedance and recirculation port flow dynamics, which are addressed by the present invention.

In some prior art recirculating Roots compressors, such as the compressor described in Houghton, the flow of recirculating gas is periodically interrupted each time a rotor lobe passes the recirculation entry port, or is halted and possibly even reversed as a displacement cavity is simultaneously opened to both a recirculation port and a discharge port. This results in a loss of momentum and flow of the recirculation fluid, creating heat, and reducing the efficiency of the recirculation fluid in cooling the compressor flow. This problem, which is inherent in many previously known Roots compressors, is overcome in the present invention, as will be made apparent in the descriptions set forth below.

In the applicant's previously issued U.S. patents cited above, certain improvements were disclosed which achieved lower operating temperatures by recirculation of the working fluid which usually required cooling for most applications. The present invention provides certain improvements in the compressors described in those patents such that the thermodynamic nature of the compression cycle has become significantly more isothermal than adiabatic, such that substantially less heat is generated in the process.

Accordingly it is the object and purpose of the present invention to provide an improved positive displacement, transverse flow, rotary gas compressor.

It is also an object and purpose of the present invention to provide a positive displacement, transverse flow rotary gas compressor having an improved gas recirculation means for reducing overheating of the compressor.

It is a further object and purpose of the present invention to provide a positive displacement rotary gas compressor which is characterized by having a continuous, steady uninterrupted flow of recirculation gas which flows from the discharge of the compressor back into the compressor.

It is also an object and purpose of the present invention to provide a rotary, positive displacement, transverse flow gas compressor that produces significantly less heat inside the compressor, and is thus capable of operating at higher sustained pressure ratios than have previously been attainable.

It is also an object of the present invention to provide a positive displacement, transverse flow, rotary gas compressor which establishes a compression cycle having a thermodynamic nature that is significantly closer to isothermal than to adiabatic, and which does not require internal cooling for operation at pressure ratios of up to ten to one (10:1).

It is yet another object of the present invention to provide a positive displacement, transverse flow rotary gas compressor which achieves improved efficiency through a substantially isothermal thermodynamic compression cycle.

SUMMARY OF THE INVENTION

The present invention integrates an open reflux flow loop operating at discharge pressure, with a multi-lobed Roots type rotary compressor. The compressor feeds input pressure gas into the reflux flow loop at constant temperature and constant volume. Power for the compression work is supplied by equivalent shaft work.

The compressor of the present invention includes a housing having mutually opposing cylindrically curved interior side walls, and having a gas inlet port located at one end of the housing between the cylindrically curved side walls. The compressor housing further includes a gas discharge port located at the opposite end of the housing from the inlet port, and also located between the cylindrically curved side walls, which opens into a distribution manifold that is connected to an outlet port. The compressor further includes a pair of intermeshed, involutely lobed rotors, also referred to as impellers, which are rotatably journalled in the housing. The impellers are driven to rotate in opposite directions so as to sweep a gas from the inlet through the discharge manifold to the discharge port. The impeller may have from five to eight lobes.

The compressor housing further includes first and second primary reflux ports formed respectively in the cylindrically curved opposing side walls between the inlet port and the discharge port. The compressor further includes first and second primary reflux conduits connecting in fluid communication the distribution manifold with the first and second primary reflux ports. The impeller lobe tips do not completely obstruct the reflux ports, and thereby do not momentarily interrupt the flow of recirculation gas as the impeller lobes rotate past the reflux ports.

In an alternative embodiment the compressor housing further includes first and second auxiliary reflux ports formed respectively in the cylindrically curved opposing side walls between the primary reflux ports and the discharge port. The compressor includes first and second auxiliary reflux conduits connecting in fluid communication the manifold with the first and second auxiliary reflux ports.

The inlet port and the discharge port are approximately equal in size to one another, and the discharge port is approximately twice the size of each of the primary reflux conduits. The primary and auxiliary reflux ports are isolated from direct fluid communication with the inlet and discharge ports.

The number of lobes of the impellers and the angular reach of the cylindrically curved interior housing side walls are related. More particularly, the angular sectors through which the wall surfaces extend, between each of the reflux ports and the discharge port, and also between each of the reflux ports and the inlet port, are preferably selected so as to be no less than the angular relationship between adjacent lobes of the impeller.

In the preferred embodiment the primary reflux ports each open into the housing at an acute angle with respect to the inner surfaces of the housing at the points where the reflux ports open into the housing. This causes the incoming recirculation gas to enter the housing in a direction that matches the direction of the rotating impeller lobes.

In the preferred embodiment primary reflux port is in the form of a linear nozzle formed by converging the reflux conduit in final approach to the opening in the compressor housing wall, such that the recirculation gas is accelerated to a velocity through the nozzle throat and into the housing that will vary between sonic velocity down to slightly above impeller tip velocity, as an impeller displacement cavity passes by the reflux port.

In the preferred embodiment each auxiliary reflux port is also in the form of a linear nozzle formed by converging the reflux conduit in final approach to the compressor housing, such that the recirculation gas is accelerated to somewhat below sonic velocity down to slightly above rotor tip velocity, as an impeller displacement cavity passes by the auxiliary reflux port.

It will be appreciated that this arrangement results in minimum flow impedance, minimum heating of the recirculation gas from flow dynamics effects, and a minimum reflux port volume adjacent to the housing; while also ensuring that the inlet port, the reflux ports, and the discharge port are at all times isolated from one another by the impeller lobes so as to prevent back flow due to direct fluid communication between the ports.

It will also be appreciated that the auxiliary reflux ports provide a longer period for reflux fluid to enter impeller displacement cavities and will raise the contained pressure closer to discharge pressure prior to release into the discharge region.

In the preferred embodiment, the impellers are each provided with six lobes. Further, the opposing interior housing walls extend through angular sectors of at least sixty (60) degrees between the proximal edges of the discharge port and each of the reflux ports, and extend through angular sectors of approximately one hundred and twenty (120) degrees between the proximal edges of the inlet port and each of the primary reflux ports. This embodiment is preferred because it results in slippage or backfill flow between the tips of the impeller lobes and the housing interior walls being collected in a following cavity not in communication with the inlet port and carried forward into discharge, and is thereby characterized by improved volumetric efficiency.

The compressor of the present invention is believed to be useful in many applications requiring continuous compression of large volumes of gas or vapor. The transverse flow arrangement and rugged rotor design permit in-line multiple staging driven by a single power source, so that very high compression system pressure ratios can be achieved. One exemplary application is the compression of natural gas for wellhead gathering and pipeline pressurization and boosting, for compressed natural gas (CNG) vehicle refueling systems, and for natural gas liquefaction process compression.

These and other aspects of the present invention will be more apparent upon consideration of the more detailed description of the invention set forth below and in the accompanying drawings.

BRIEF DESCRIPTION OF THE DRAWINGS

The accompanying drawings are incorporated into and form a part of this specification and, when taken in combination with the detailed description below, illustrate the operation and construction of the best mode of the invention known to the inventor.

In the Figures.

DESCRIPTION OF THE PREFERRED EMBODIMENTS

Figure 1:
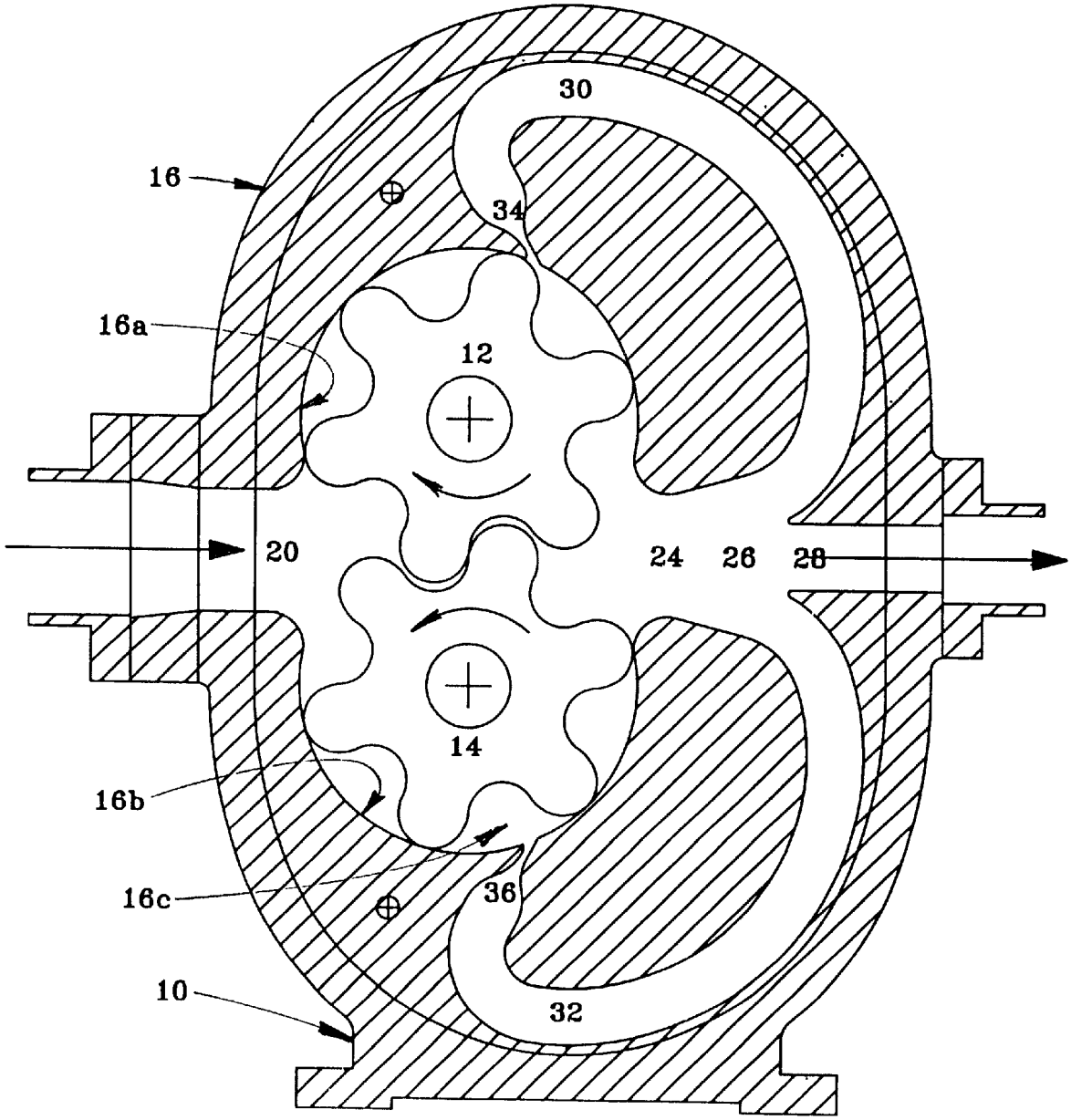
FIG. 1 is an end view in cross-section of the preferred embodiment of the rotary compressor of the present invention having a single pair of reflux ports.
Figure 2:
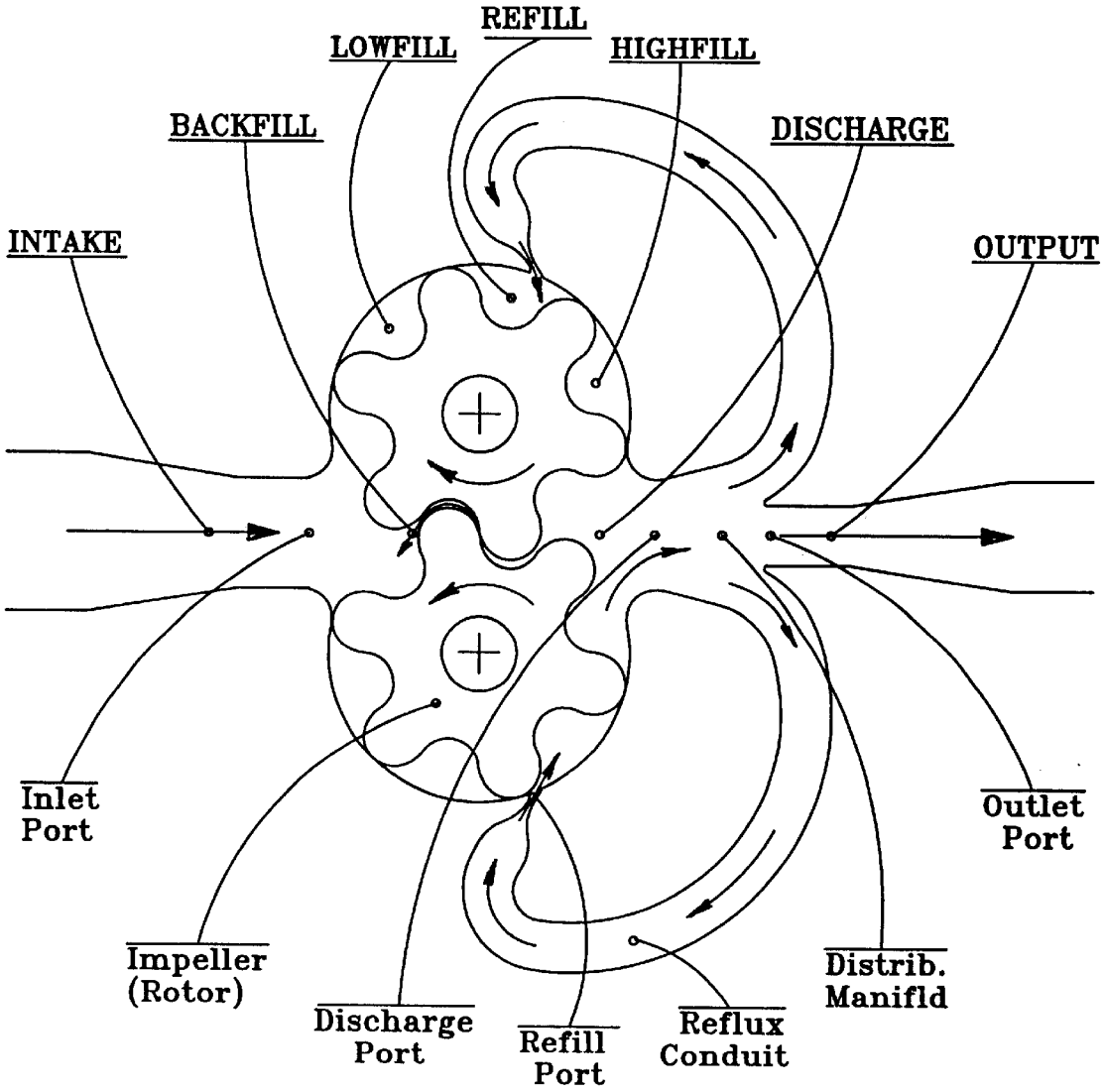
FIG. 2 displays the gas flow paths associated with the compression cycle.

Referring to FIGS. 1 and 2, there is illustrated a preferred embodiment of the positive displacement, recirculating rotary compressor 10 of the present invention. The compressor includes two six-lobed impellers 12 and 14 which are rotatably mounted within a hollow housing 16. The housing 16 has an interior surface which includes two mutually opposing, cylindrically curved side walls 16*a* and 16*b*. The housing also includes flat end walls, only one of which, 16*c*, is shown. Briefly, the outside diameters of the lobed impellers 12 and 14 correspond, to within a preferable tolerance of a few thousandths of an inch, the diameters of the cylindrically curved side walls 16*a* and 16*b*. The lobed impellers 12 and 14 are substantially identical to one another, and will therefore be described in greater detail at various points below, primarily by reference to the construction and operation of impeller 12, shown generally on the upper half of the Figures. The six lobes of each of the impellers 12 and 14 are substantially identical lobes to one another.

Briefly, the impellers 12 and 14 are driven to operate in opposite directions about parallel axes of rotation which extend along the central axes of the impellers 12 and 14. The axes of the impellers are also colinear with the central longitudinal axes of the cylindrically curved interior walls 16*a* and 16*b*, respectively. The impellers 12 and 14 are maintained in proper angular relationship to one another, which is at an angular phase relationship of 30 degrees with respect to one another, by their normal intermeshing relationship and also by means of timing gears (not shown), which are located outside of the primary chamber of the housing 16.

In operation, a gas is admitted to the compressor through an inlet port 20 that is formed at one end of the housing 16 and which is generally centered between the side walls 16*a* and 16*b*. An admitted parcel of gas is swept through the housing 16 by the impellers 12 and 14, occupying a displacement cavity which is defined by a pair of adjacent impeller lobes and the walls of the compressor housing 16. The gas is swept out of the housing 16 through a compressor housing discharge port 24 located at the opposite end of the housing from the inlet port 20, and into a distribution manifold 26.

From the distribution manifold 26, part of the gas flows through an outlet port 28 which opens from the distribution manifold 26, and another part of the gas is recirculated back to the compressor housing 16 through a pair of primary reflux conduits 30 and 32. The reflux conduits 30 and 32 connect the distribution manifold 26 to a pair of primary reflux ports 34 and 36 respectively. The reflux ports 34 and 36 open into the cylindrically curved interior surfaces 16*a* and 16*b* of the compressor housing 16. In the preferred embodiment the reflux ports 34 and 36 are each oriented so that gas entering the compressor housing 16 enters the housing at an acute angle with respect to the tangential surfaces of the interior walls 16*a* and 16*b* of the housing with the acute angle being directed in the direction of travel of the impeller lobes. A preferred angle for the six-lobe impeller is approximately 50 to 55 degrees from the direction normal to the housing surfaces 16*a* and 16*b* at the point of entry.

It will also be noted that the primary reflux conduits 30 and 32 converge in final nozzles that extend the full length of the impellers. As a result of this arrangement the recirculation gas flows at a low velocity through the reflux conduits 30 and 32 until it reaches the primary reflux ports 34 and 36, where it is accelerated and then enters the compressor housing 16 at a velocity varying from sonic down to slightly above impeller tip speed.

In rotation, the lobes of impellers 12 and 14 intermesh in flush contact with one another so that there is at all times a high-impedance clearance between the impellers, which clearance is small in comparison with the volumetric displacement of the compressor, and which essentially restricts, by sonic choking, back flow of high pressure discharge gas through the compressor.

The primary reflux ports 34 and 36 open into the housing 16 so as to function to recycle discharge pressure gas back into the compressor housing 16, thereby raising the gas pressure in the displacement cavities while largely avoiding the heat gain that results from adiabatic mechanical compression within the compressor, and reducing the tendency of the compressor to overheat when the ratio of discharge pressure to intake pressure is high. Heat gain associated with recycling the discharge pressure gas back into the housing 16 is that resulting from changes in momentum and from boundary layer viscous friction in the flowing gas. Only the final increase in pressure that occurs as displacement cavity gas enters the discharge region is gained from and due to adiabatic compression at a very low pressure ratio.

It will be understood that all of the ports, including the inlet port 20, the discharge port 24, and the primary reflux ports 34 and 36, as well as the distribution manifold 26, may preferably be elongate or rectangular in shape and extend parallel to the axes of, and for the full length of, the impellers 12 and 14.

Figure 3:
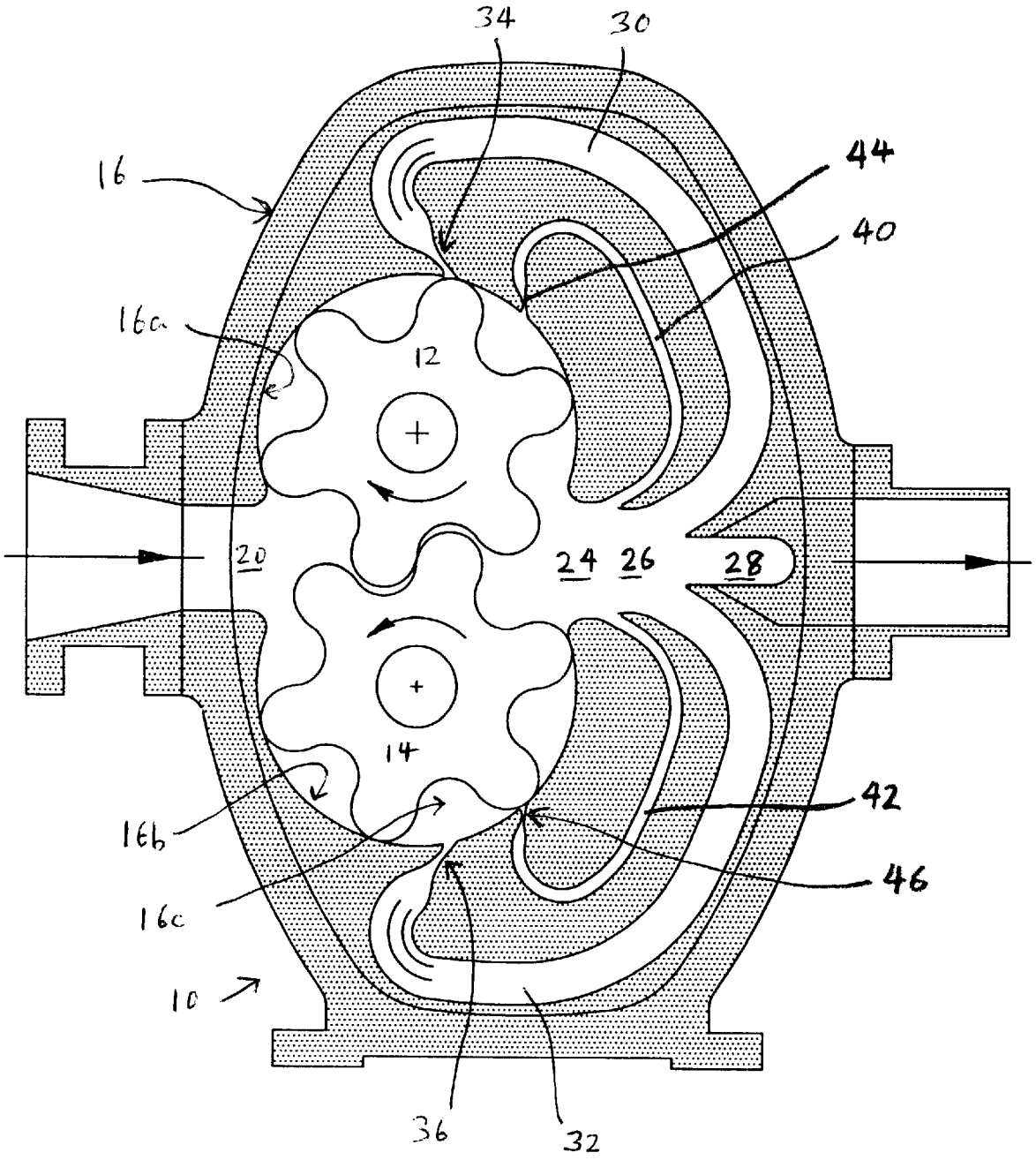
FIG. 3 is an end view in cross section of the preferred embodiment of the rotary compressor of the present invention having both a primary and an auxiliary pair of reflux ports.

FIG. 3 illustrates a second preferred embodiment of the invention. In FIG. 3, structural elements which are substantially identical to those shown in FIG. 1 are numbered that same as those shown in FIG. 1.

The embodiment illustrated in FIG. 3 includes, in addition to the elements described above with respect to FIGS. 1 and 2, a pair of auxiliary reflux conduits 40 and 42, which augment the function of the primary reflux conduits 30 and 32. The auxiliary reflux conduits 40 and 42 provide fluid communication between the distribution manifold 26 and the compressor housing 16 in a manner similar to the primary conduits 30 and 32. Auxiliary conduits 40 and 42 converge in final approach to the cylindrically curved sidewalls 16*a* and 16*b*, to terminate in a pair of auxiliary refill ports 44 and 46, respectively, which open onto the sidewalls 16*a* and 16*b* of the housing 16 at positions downstream from the openings of the primary refill ports 34 and 36. The auxiliary conduits 40 and 42 open onto the distribution manifold 26 at a position just upstream from the openings of the primary conduits 30 and 32, such gas traveling through the auxiliary conduits 40 and 42 travels along circuitous path which is inside the loop formed by primary conduits 30 and 32.

The auxiliary reflux conduits 40 and 42 and their associated ports 44 and 46 are smaller in diameter than the primary conduits 30 and 32 and ports 34 and 36, due to the fact that the auxiliary ports 44 and 46 open onto the compressor side walls 16*a* and 16*b* at points downstream from the primary ports 34 and 36 and thus operate on gas in the displacement cavities which is already pressurized to some extent by discharge gas introduced through the primary ports 30 and 32. Consequently a smaller gas flow volume is necessary in the auxiliary conduits 40 and 42.

The auxiliary conduits 40 and 42 function to extend the reflux fill time and obtain more complete filling of each displacement cavity prior to discharge. Like the primary reflux conduits 30 and 32 and ports 34 and 36, the auxiliary conduits 40 and 42 and their ports 44 and 46 function to recycle discharge gas back into the compressor 16, thereby raising the gas pressure in the displacement cavities while minimally raising the increase in temperature that normally accompanies adiabatic compression of the gas in the displacement cavities. Like the primary reflux ports 34 and 36, the auxiliary ports 44 and 46 constitute linear nozzles which are oriented at an acute angle with respect to the surface of the curved side walls 16*a* and 16*b*, and directed in the direction of travel of the impeller lobes. A preferred angle for the reflux ports 44 and 46, for a six-lobe impeller, is between 50 to 55 degrees from the direction normal to the side wall surfaces 16*a* and 16*b* at the point of entry.

The positions of the primary and auxiliary reflux ports on the compressor walls are dictated in part by the number of impeller lobes. For a five-lobed impeller, the angle between the proximal edge of the discharge port 24 and the auxiliary reflux port is preferably at least 72 degrees, and the angle between the proximal edge of the input port 20 and the primary reflux port 34 is between 120 140 degrees. For a 6-lobed impeller, the angle between the proximal edge of the discharge port 24 and the auxiliary reflux port 44 is preferably at least 60 degrees, and the angle between the proximal edge of the input port 20 and the primary reflux port 34 is between 110 to 120 degrees. For a 7-lobed impeller, the angle between the proximal edge of the discharge port 24 and the auxiliary reflux port 44 is preferably about 52 degrees, and the angle between the proximal edge of the input port 20 and the primary reflux port 34 is between approximately 100 and 110 degrees. For an 8-lobed impeller, the angle between the proximal edge of the discharge port 24 and the auxiliary reflux port 44 is preferably about 45 degrees, and the angle between the proximal edge of the input port 20 and the primary reflux port 34 is between 85 and 90 degrees. While these angles are given for only the components shown as being the upper half of the compressor shown in FIG. 3, it will be understood that the same angles are prescribed for the symmetrically identical lower half of the compressor.

The angle entry angles of the primary and auxiliary reflux ports are also somewhat dependent on the number of impeller lobes. For a five-lobe impeller, this angle is preferably approximately 50 degrees from normal. For a six-lobe impeller, the entry angle is preferably approximately 50 to 55 degrees from normal. For a seven-lobe impeller, the entry angle is preferably approximately 55 degrees from normal. And for an eight-lobe impeller, the entry angle is preferably approximately The high pressure ratio capability of the compressor of the present invention is a consequence of the fact that pressure gain in the housing results from optimizing the flow of recirculated gas back into the housing prior to discharge, as opposed to total adiabatic compression and associated heating. In this regard, with increasing gas pressure ratios temperature increase from near-isothermal compression becomes linear, whereas temperature increases associated with adiabatic, or isentropic, compression are exponential with specific heat ratio relationships.

It is believed that compressors of the present invention will find utility in a wide variety of applications where high volume, sustained compression is required at single stage pressure ratios up to ten to one (10:1). Inasmuch as Roots compressors have heretofore only been capable of sustained operation at pressure ratios not exceeding two to one (2:1), or in special cases with recirculation, three to one (3:1), due to limitations imposed by overheating of the compressor components; the higher attainable pressure ratio capability of the present invention will make it useful in a wide variety of applications where the use of positive displacement rotary Roots compressors has not been previously considered feasible. Aside from the high volumetric capacity, the process gains advantage from being non-contaminating.

It will be appreciated that the temperature of the gas being processed has been sufficiently reduced so that no means of heat removal are required, either internal or external. The problems associated with overheating and with thermal distortion have been eliminated. The compressor is characterized by having a more uniform process fluid temperature, so that temperature differences in the transverse flow direction from inlet to discharge do not cause thermal distortion difficulties. As a consequence of the substantially isothermal nature of the compression cycle, the compressor provides an inherent energy efficiency advantage that improves with increasing pressure ratio.

It will also be appreciated that the compression cycle is based on a constant volume, variable mass process; and that the compression cycle and the physical design of the compressor have evolved together and are considered inseparable.

Although the present invention is described herein with reference to two preferred embodiments, it will be understood that various modifications, substitutions, and alterations, which may be apparent to one of ordinary skill in the art, may be made without departing from the essence of the invention. Accordingly, the present invention is defined by the following claims.

The embodiments of the invention in which patent protection is claimed are defined as follows:

1. A positive displacement, transverse flow, recirculating rotary gas compressor comprising:

a housing having two mutually opposing cylindrically curved interior side walls, said housing including a gas inlet port at one end located between said mutually opposing cylindrically curved interior side walls and a gas discharge port located at the opposite end of said housing from said inlet port and also located between said mutually opposed cylindrically curved interior side walls; said discharge port opening into a flow distribution manifold having a gas outlet port;

first and second involutely lobed impellers journalled to said housing for rotation in opposite directions; each of the impellers having at least five lobes; said impellers being intermeshed so as to form a high impedance seal when said impellers are rotated in opposite directions;

said housing including first and second primary reflux conduits connecting said distribution manifold with a pair of first and second primary reflux ports, respectively, said primary reflux ports being formed in said mutually opposing cylindrically curved interior side walls between said inlet port and said discharge port, said primary reflux ports opening into said interior walls of said housing at an acute angle with respect to said interior walls of said housing, whereby gas entering said housing through said primary reflux ports enters in a direction approximating the direction of travel of said impellers;

said housing further including first and second auxiliary reflux conduits connecting said distribution manifold with a pair of first and second auxiliary reflux ports, respectively, formed in said mutually opposing cylindrically curved interior side walls, said auxiliary reflux ports opening onto said sidewalls at positions between said primary reflux ports and said discharge port, said auxiliary reflux ports opening into said interior walls of said housing at an acute angle with respect to said interior walls of said housing, whereby gas entering said housing through said auxiliary reflux ports enters in a direction approximating the direction of travel of said impellers;

said primary and auxiliary reflux ports being configured as linear nozzles which converge in final approach to said interior walls of said housing, whereby gas is accelerated from a low velocity in said conduits to a higher velocity varying from sonic speed down to impeller lobe tip speed as gas passes through said reflux ports and enters said housing, said reflux ports being shaped, sized, and directed to obtain maximum fluid mass within displacement cavities of said impellers prior to release into discharge;

said primary and auxiliary reflux ports being positioned on said side walls at an angular displacement from said discharge port so as to be isolated from direct fluid communication with said discharge port by said impeller lobes.

2. The positive displacement, transverse flow recirculating rotary gas compressor defined in claim 1 wherein each of said impellers has five lobes, and wherein said mutually opposed cylindrically curved interior surfaces of said housing extend through angular sectors of at least 72 degrees between the proximal edges of said discharge port and each of said auxiliary reflux ports, and extend through angular sectors of approximately 120 to 140 degrees between the proximal edge of said inlet port and each of said primary reflux ports; and wherein the entry angle of each of said primary and auxiliary reflux ports is approximately 50 degrees from the direction normal to said interior surfaces of said housing, and in the direction of travel of said impellers.

3. The positive displacement, transverse flow recirculating rotary gas compressor defined in claim 1 wherein each of said impellers has six lobes, and wherein said mutually opposed cylindrically curved interior surfaces of said housing extend through angular sectors of at least 60 degrees between the proximal edges of said discharge port and each of said auxiliary reflux ports, and extend through angular sectors of approximately 110 to 120 degrees between the proximal edge of said inlet port and each of said primary reflux ports; and wherein the entry angle of each of said primary and auxiliary reflux ports is approximately 50 to 55 degrees from the direction normal to said interior surfaces of said housing, and in the direction of travel of said impellers.

4. The positive displacement, transverse flow recirculating rotary gas compressor defined in claim 1 wherein each of said impellers has seven lobes, and wherein said mutually opposed cylindrically curved interior surfaces of said housing extend through angular sectors of at least 52 degrees between the proximal edges of said discharge port and each of said auxiliary reflux ports, and extend through angular sectors of approximately 100 to 110 degrees between the proximal edge of said inlet port and each of said primary reflux ports; and wherein the entry angle of each of said primary and auxiliary reflux ports is approximately 55 degrees from the direction normal to said interior surfaces of said housing, and in the direction of travel of said impellers.

5. The positive displacement, transverse flow recirculating rotary gas compressor defined in claim 1 wherein each of said impellers has eight lobes, and wherein said mutually opposed cylindrically curved interior surfaces of said housing extend through angular sectors of at least 45 degrees between the proximal edge of said discharge port and each of said auxiliary reflux ports, and extend through angular sectors of approximately 85 to 90 degrees between the proximal edge of said inlet port and each of said primary reflux ports; and wherein the entry angle of each of said primary and auxiliary reflux ports is approximately 55 to 60 degrees from the direction normal to said interior surfaces of said housing, and in the direction of travel of said impellers.

6. A positive displacement, transverse flow, recirculating rotary gas compressor comprising:

a housing having two mutually opposing cylindrical curved interior side walls, said housing including a gas inlet port at one end located between said mutually opposing cylindrically curved interior side walls and a gas discharge port located at the opposite end of said housing from said inlet port and also located between said mutually opposed cylindrically curved side walls; said gas discharge port opening into a flow distribution manifold having a gas outlet port;

said housing further including first and second gas reflux ports formed respectively in said mutually opposing cylindrically curved side walls between said inlet port and said discharge port;

first and second involutely lobed impellers journalled for rotation in opposite directions within said housing; each of the impellers having six lobes; said impellers being intermeshed so as to form a high impedance seal when said impellers are rotated in opposite directions;

first and second primary reflux conduits connecting said manifold with first and second reflux ports, said reflux ports opening into said interior walls of said housing at an acute angle with respect to said interior walls of said housing, whereby gas entering said housing through said reflux ports enters in a direction approximating the direction of travel of said impellers;

said first and second primary reflux ports configured as linear nozzles formed by converging said first and second reflux conduits in final approach to said interior walls of said housing, whereby recirculation gas is accelerated from a low velocity in said first and second reflux conduits to a higher velocity varying from sonic down to impeller lobe tip speed as the reflux gas passes through the nozzle throat of said first and second reflux ports and enters said housing, said first and second reflux ports being shaped, sized, and directed to obtain maximum contained fluid mass within displacement cavities of said impellers prior to release into discharge, and wherein said mutually opposed cylindrically curved interior surfaces of said housing extend through angular sectors of at least 60 degrees between the proximal edges of said discharge port and each of the said reflux ports, and extend through angular sectors of approximately 120 degrees between the proximal edges of said inlet port and each of said reflux ports; and wherein the entry angle of each of said reflux ports is approximately 50 to 55 degrees from the direction normal to said interior surfaces of said housing, and in the direction of travel of said impellers; and said inlet port and said discharge port being approximately equal in size to one another; said discharge port being approximately twice the size of each of said recirculation conduits; said inlet, said discharge and said recirculation ports being isolated from direct fluid communication with one another.

7. The positive displacement, transverse flow recirculating rotary gas compressor defined in claim 6 wherein each of said impellers has five lobes; and wherein said mutually opposed cylindrically curved interior surfaces of said housing extend through angular sectors of at least 72 degrees between the proximal edges of said discharge port and each of said reflux ports, and extend through angular sectors of approximately 125 to 140 degrees between the proximal edges of said inlet port and each of said reflux ports; and wherein the entry angle of each of said reflux ports is approximately 50 degrees from the direction normal to said interior surfaces of said housing, and in the direction of travel of said impellers.

8. The positive displacement, transverse flow recirculating rotary gas compressor defined in claim 6 wherein each of said impellers has four lobes; and wherein said mutually opposed cylindrically curved interior surfaces of said housing extend through angular sectors of at least 90 degrees between the proximal edges of said discharge port and each of said reflux ports, and extend through angular sectors of at least 90 degrees between the proximal edges of said inlet port and each of said reflux ports; and wherein the entry angle of each of said reflux ports is approximately 45 to 50 degrees from the direction normal to said interior surfaces of said housing, and in the direction of travel of said impellers.

* * * * *